US006923748B1

(12) United States Patent
Mauz et al.

(10) Patent No.: US 6,923,748 B1
(45) Date of Patent: Aug. 2, 2005

(54) SEQUENTIAL CONTRACTION MUSCLE TRAINING DEVICE

(76) Inventors: John J. Mauz, 3669 Silver Fox Cir., Flagstaff, AZ (US) 86004; Richard A. Staley, 3411 S. Gillenwater, Flagstaff, AZ (US) 86001

( * ) Notice: Subject to any disclaimer, the term of this patent is extended or adjusted under 35 U.S.C. 154(b) by 432 days.

(21) Appl. No.: 10/256,775

(22) Filed: Sep. 27, 2002

(51) Int. Cl.[7] ..... A63B 22/00; A63B 69/16
(52) U.S. Cl. ..... 482/70; 482/52; 482/51
(58) Field of Search ..... 482/70, 77, 146–147, 482/51–53, 79, 80, 57, 71; 434/253

(56) References Cited

U.S. PATENT DOCUMENTS

| | | | | |
|---|---|---|---|---|
| 3,316,898 | A | 5/1967 | Brown | |
| 3,703,284 | A | 11/1972 | Hesen | |
| 3,759,511 | A | 9/1973 | Zinkin et al. | |
| 4,340,214 | A * | 7/1982 | Schutzer | 482/51 |
| 4,509,742 | A | 4/1985 | Cones | |
| 4,720,093 | A | 1/1988 | Del Mar | |
| 5,039,088 | A | 8/1991 | Shifferaw | |
| 5,116,296 | A | 5/1992 | Watkins et al. | |
| 5,242,343 | A | 9/1993 | Miller | |
| 5,383,829 | A | 1/1995 | Miller | |
| 5,399,134 | A | 3/1995 | Abboudi et al. | |
| 5,401,226 | A * | 3/1995 | Stearns | 482/53 |
| 5,451,194 | A * | 9/1995 | Harrigan | 482/70 |
| 5,460,596 | A | 10/1995 | Brady | |
| 5,788,615 | A | 8/1998 | Jones | |
| 5,853,354 | A | 12/1998 | Kubota | |
| 6,059,701 | A | 5/2000 | George et al. | |
| 6,117,095 | A | 9/2000 | Daggett et al. | |
| 6,183,397 | B1 * | 2/2001 | Stearns et al. | 482/52 |
| 6,196,950 | B1 | 3/2001 | Emick | |
| 6,296,594 | B1 | 10/2001 | Simonson | |
| 6,398,695 | B2 * | 6/2002 | Miller | 482/52 |
| 6,780,142 | B1 * | 8/2004 | Takizawa et al. | 482/8 |

* cited by examiner

*Primary Examiner*—Jerome W. Donnelly

(57) ABSTRACT

A training method and device for the lower body providing a mode of exercise that manifests as a functional, closed-kinetic-chain training of the gluteus maximus and the hamstrings in a natural sequential firing pattern. The device construction allows an upright stance so that during exercise the lower body mimics a stride action, as in walking. By combining this natural stride action with adjustable resistance elements in the device, a wide range of uses, from strength training to rehabilitation, are achieved. The device generally includes footplates that are movable in forward and backward directions and also can be simultaneously moved upward against resistance. The heel of the foot can simultaneously be raised with respect to the toe of the foot, also against resistance.

14 Claims, 6 Drawing Sheets

SEQUENTIAL CONTRACTION MUSCLE TRAINING DEVICE

FIELD OF THE INVENTION

The present invention relates to the field of devices and methods for exercising the human body, particularly the gluteus maximus and hamstring muscles.

BACKGROUND OF THE INVENTION

Physical performance depends heavily on the attributes of muscular development such as flexibility, strength, power, endurance, and neuromuscular control. The ultimate goal of developing these muscular attributes is to improve muscle performance. Training to improve running and jumping performance, rehabilitate injured knees, or prevent injuries to the lower leg involves activity specific training, and development of strength, power, and neuromuscular control.

Various types of devices have been created for the exercise and training of various muscle groups. U.S. Pat. No. 5,788,615 to Jones details a device for exercising the quadriceps and hamstrings while lying on the back. U.S. Pat. No. 6,196,950 to Emick shows a weight attachment device so one can stand and exercise the hamstrings. U.S. Pat. No. 3,759,511 to Zinkin et al. describes a device for strengthening the quadriceps while lying face down at approximately 45 degrees. These types of devices are typically for strength training. Using adjustable weights or the like, a particular physical movement is performed to strengthen the muscles. This type of training isolates specific muscles but does not synergistically train those muscles to mimic the functional muscular activity.

Other devices such as stationary bicycles (e.g., U.S. Pat. No. 4,509,742 to Cones), climbing machines (e.g., U.S. Pat. No. 4,720,093 to Del Mar), or other stationary exercises devices (e.g., U.S. Pat. No. 5,242,343 to Miller), offer a wider range of motion for the hips and legs. These reciprocating devices provide for more even physical development and a maximum level of aerobic exercise. Some include elements that incorporate the movement of the arms and shoulders during exercise. These devices, however, are all reciprocal in nature and the footpads or plates for each foot are linked together such that pushing down on one pad raises the opposite pad. Although these devices offer a wide range of motion, they do not isolate the lower extremity muscle groups.

Treadmill type devices (e.g., U.S. Pat. No. 3,703,284 to Hesen), offer walking and/or running exercise, and are similar to the reciprocating devices above in that they provide for more even physical development in the area of aerobic exercise.

There remains a need for a machine that can effectively train and exercise the gluteus maximus and the hamstrings in a natural manner consistent with a walking or running stride.

SUMMARY OF THE INVENTION

The present invention is an exercise method and device for strengthening and training the muscles of the hip and leg, specifically the gluteus maximus (GM) and the hamstrings (HS), in a natural, functional manner. It mimics the walking or running stride and thus naturally isolates and exercises the hip extensors, or gluteus maximus (GM), and the knee flexors, or hamstrings (HS), in their natural firing sequence. It also trains the quadriceps (QD) in its proper roll as antagonist to the HS. The device includes a footplate that secures a foot of the user at all times and limits the freedom of movement of the foot. The attachment of the foot to the surface of the footplate ensures that the lower extremities are guided through a multi-joint, closed-kinetic-chain, functional movement pattern involving the foot, ankle, knee and hip. This closed-kinetic-chain mode of exercise isolates and sequentially loads the GM and HS, in their natural firing sequences, during the exercise cycle. The device of the present invention is also non-reciprocal, and though usually operated sequentially, each leg is properly exercised independently and in turn without being influenced by the opposite leg.

In jumping, the hips and knees are loaded prior to an explosive, sequential action of the muscles. Likewise, during running, hip extension is followed closely by knee flexion in which the hip/knee joint action and accompanying muscular contractions and control occur synergistically. This synergistic muscle contraction and control involving the GM, HS and, QD, is important for proper neuromuscular training.

Isolating specific muscle groups for training can strengthen these muscles. The present invention, while isolating and strength training the GM and HS, also trains the neuromuscular pathways that control the hip/knee joint complex. With the functional, sequentially firing, closed-kinetic-chain mode of training provided by the present invention, the exerciser is now training in a way that specifically mimics functional muscular action needed to develop increased strength, power, and neurological activity that can improve running speed and jumping skills. Electromyographic (EMG) recordings of subjects exercising with the present invention demonstrate a high degree of GM and HS activity. The machine of the present invention isolates the HS with resistance, after activation of the GM.

Training the GM and HS to help prevent injury to the knee is also an aspect of the present invention. The HS and QD are dynamic stabilizers of the knee, but the HS is often disproportionately weaker, especially in females, than the QD. This strength difference can add to the likelihood of knee injuries, especially during active sports such as soccer or basketball. The present invention provides an ideal method of exercise for functional strength training of the GM and HS by combining a closed-kinetic-chain mode of exercise with a natural sequential firing pattern. This is the optimal type of training for joint stability of the lower extremities.

Another aspect of the present invention is rehabilitation. When individuals sustain injuries to the anterior cruciate ligament (ACL) or have reconstructive surgery to replace the ACL, HS training is a standard part of the rehabilitation program. The closed-kinetic-chain aspect of the present invention provides for a safe, stabilizing training regime, and with adjustable resistance, can be used early on and throughout the rehabilitation program.

The exercise device generally includes a frame for attachment of movable components, the frame remaining stationary during use of the device. One subframe is pivotally attached to the forward end of the frame for the foot and leg intended to be exercised. A footplate is secured to the subframe in a fashion that allows the user's foot to move forwardly or rearwardly with respect to the subframe, while a resistance element provides resistance to rearward travel. The pivot at the front of the subframe allows the foot to be raised with respect to the frame, against a resistance element, at the same time that it is moved forwardly or rearwardly. The footplate includes toe and heel attachments.

The heel attachment allows the heel to be raised with respect to the toe during use of the device, also against a resistance element. A body support assembly, including a handlebar, is attached to the front of the frame for upper body support and stability during use of the device.

DETAILED DESCRIPTION OF THE INVENTION

Figure 1:
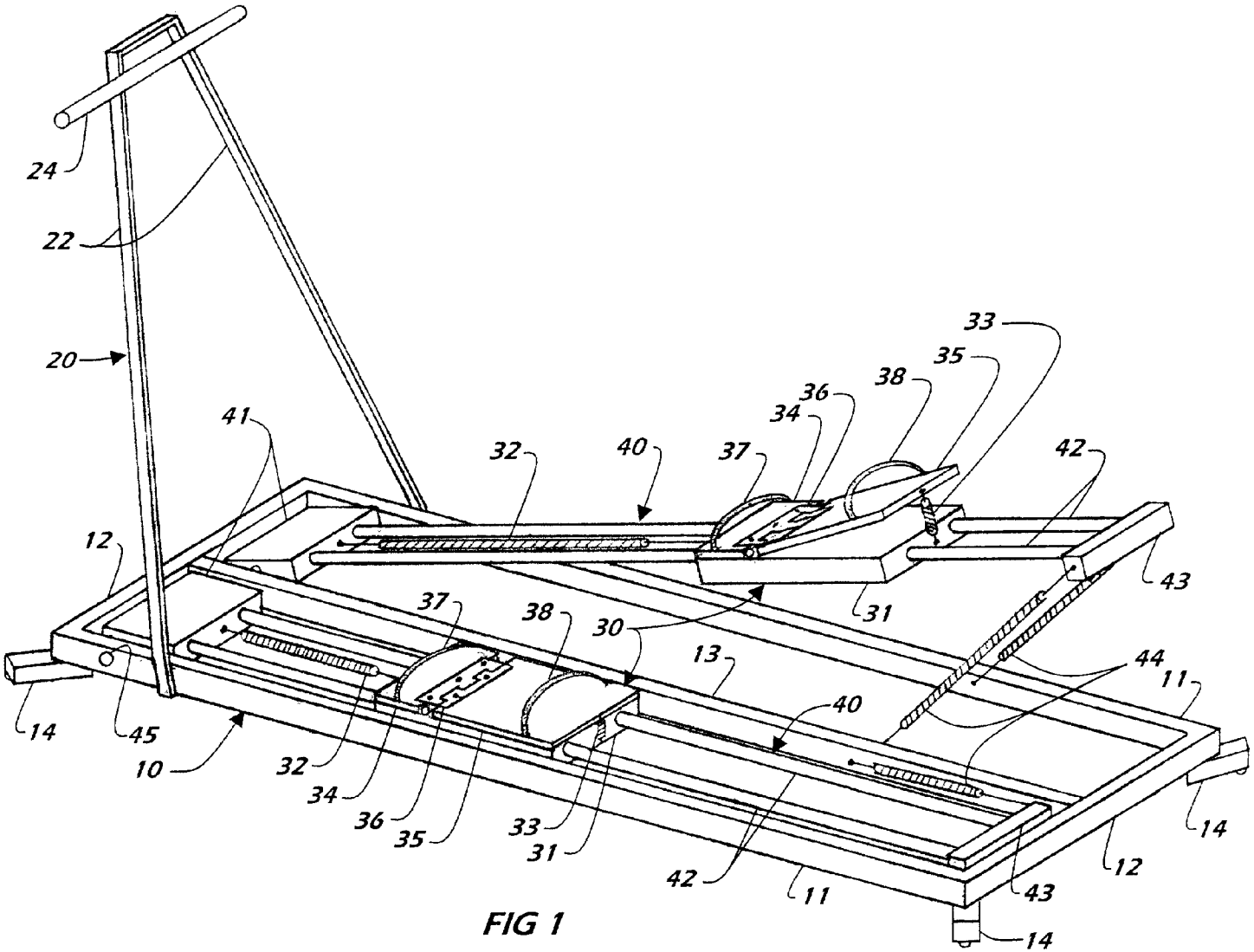
FIG. 1 is a perspective view of the exercise device embodying the principles of the present invention.

The exercise/training device shown in FIG. 1 comprises four main assemblies; a frame, e.g., frame body assembly 10, a body support assembly 20, two footplate assemblies 30, and two slide bar assemblies 40, each of which is pivotally affixed to the forward end of the frame body assembly 10. The frame body assembly 10 provides the support structure for the device and is a generally rectangular frame with a forward end and a back end wherein the forward end is in front of a user and the back end is to the rear of a user. It generally comprises two longer side members 11, two shorter end members 12, and a single long central member 13. The frame body 10 preferably rests on four lateral supports 14 extending out from and at each corner of the rectangular framework. These lateral supports 14 are of sufficient length to provide lateral stability during exercise and contain elements at each end capable of leveling the device during setup. They also incorporate materials that prevent scarring of a floor surface and skidding of the device.

Attached to the forward end of the long axis of the frame body 10 is the body support assembly 20. The body support assembly 20 provides support and balance for the exerciser during use and is made up of two upright members 22 and a handlebar 24. The bottom end of the body support assembly 20 is attached to the forward end of the frame body assembly 10 by having one of each of the uprights 22 arise from one of each of the long side members 11. The plane of the body support assembly 20 is preferably within about 15 degrees of perpendicular to the plane of the frame body assembly 10. Handlebar 24 is a straight or slightly bent, rigid tube or rod, not unlike a bicycle handlebar, and is attached to the two upright members 22 of the top end of body support assembly 20. It is in the plane of the body support assembly 20 but is substantially perpendicular to both upright members 22. The handlebar 24 may be made so as to be adjustable in height to allow for balance and support of a person during training and exercise.

Also attached to the forward end of the frame body 10 are the two slide bar assemblies 40, one for each foot. These are preferably identical, but are not linked together and thus each can pivot independently about the common pivot axle 45. Each slide bar assembly 40 includes a pivot block 41, the shared pivot axle 45, two slide bars 42, end cap 43, and pivot resistance elements 44. The pivot axle 45 is attached to the forward end of the frame body assembly 10 within the confines of the two long side members 11 and the two short end members 12 and parallel to the short end members 12. It is a rod or tube of round cross-section, rigid enough to withstand the forces exerted upon it during the use of the device. Pivot axle 45 is sufficiently back from the short end member 12 so that the pivot blocks 41 can swing about the pivot axle 45 without contacting the short end member 12.

The pivot blocks 41, along with the pivot axle 45, comprise the forward end of the slide bar assemblies 40. Each pivot block 41 rides on, and is free to pivot about, pivot axle 45. The two slide bars 42 of each assembly are rigidly attached to the respective pivot block 41 and are positioned on the pivot block 41 such that, in the down or rest position, a plane through the slide bars 42 is substantially parallel to the plane of the frame body assembly 10. The slide bars 42 extend back and terminate in the end caps 43 such that the length of the slide bar assembly 40 is about the same length as the long axis of the frame body assembly 10. The spacing of the slide bars 42 at the end caps 43 is the same as the spacing at the pivot blocks 41 so that the slide bars 42 are parallel along their length. Thus by pivoting about the pivot axle 45, the slide bar assembly 40 follows a fixed arcuate path from a position in the plane of the frame body assembly 10 to a position in the plane of the body support assembly 20. Attached to the end caps 43 and to the frame body assembly 10 are the pivot resistance elements 44. These may be, for example, elastic bands, springs, hydraulic or pneumatic elements and thus can provide fixed or adjustable resistance to the pivoting of the slide bar assembly from its down or rest position in the plane of the frame body assembly 10, up toward the plane of the body support assembly 20.

Completing this embodiment of the device are the two identical footplate assemblies 30, one on each slide bar assembly 40. The footplate assemblies 30 are comprised of the anchor block 31, the toe plate 34, the heel plate 35, the footplate hinge 36, the toe strap 37, the heel strap 38, the stride resistance element 32, and the heel plate resistance element 33. The rectangular anchor block 31, whose long axis is parallel to the long axis of the slide bar assembly 40, provides a platform for the elements that are used to secure the foot during use of the device. Anchor block 31 captures and rides on the two slide bars 42 of the slide bar assembly 40 using linear bearings or bushings or the like so that it slides smoothly without sticking or jerking. This capture of the slide bars 42 limits the movement of the anchor block 31 to a simple back and forth motion in the plane of the slide bars 42 independent of the position of the slide bar assembly 40 as it rotates about the pivot axle 45. The toe plate 34 and heel plate 35, connected to one another by the footplate hinge 36, are located on top of the anchor block 31 so the long axis is parallel to the long axis of the anchor block 31. The toe plate 34 is securely attached to the front end of the anchor block 31 thus securing half of the footplate hinge 36 and allowing the heel plate 35 which is attached to the other half of the footplate hinge 36 to rotate up off the anchor block 31. When the user's foot is properly affixed to the toe plate 34 and heel plate 35 with the toe strap 37 and heel strap 38 such that the ball of the foot is over the footplate hinge 36, the pivot at the hinge allows the foot to bend in a natural manner and still be securely attached to the device. The toe strap 37 and heel strap 38 can be leather, Velcro, elastomeric material or the like. They are made and positioned such that they not only securely fix the foot of an exerciser to the footplate assemble 30, but secure the foot in the proper position with the ball of the foot over the footplate hinge 36. The stride resistance element 32 and the heel plate resistance element 33 provide resistance to the respective parts and can be springs, elastic elements, pneumatic or hydraulic elements or the like and thus may be a constant or adjustable resistance. The stride resistance element 32 provides resistance to the sliding of the anchor block 31 from the front to the back of the slide assembly 40, and the heel plate resistance element 33 provides resistance to the pivot of the heel plate 35 about the footplate hinge 36.

Figure 2:
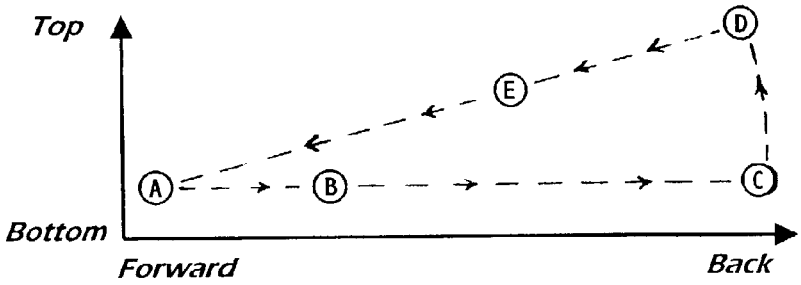
FIG. 2 is a schematic of a typical foot travel path.

FIG. 2 is a schematic describing a typical foot travel path during use of the present invention. It is only typical because the foot travel path is not fixed by the device but is determined by the exerciser. Within the limits of the device, and without requiring any adjustments, the sliding and pivotal elements of the present invention allow a wide variety of foot travel paths based on the exerciser's stride length, the type of training pursued, or input from a physician, physical therapist or trainer.

Figure 3A:
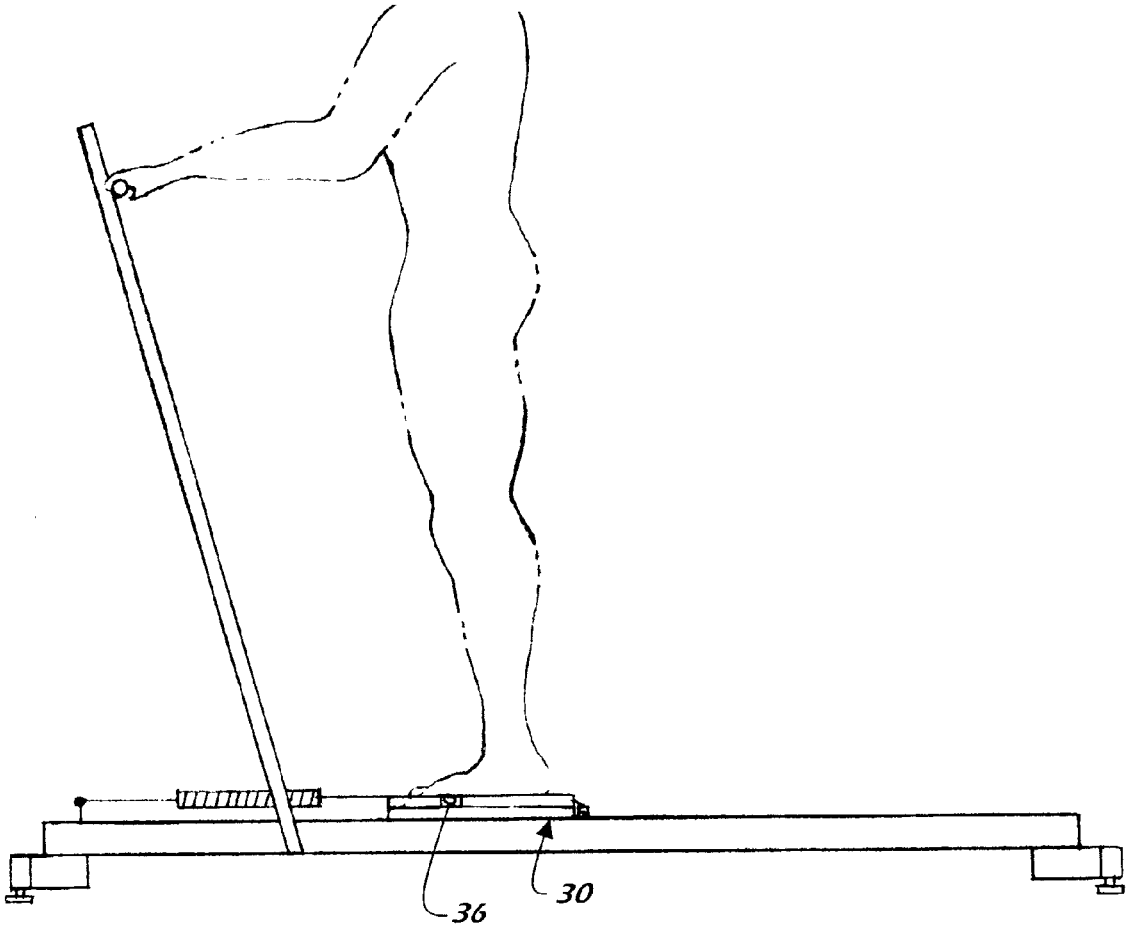
FIGS. 3A–3E are detailed representations of a foot travel path and the corresponding hip, leg, and foot positions.
Figure 3B:
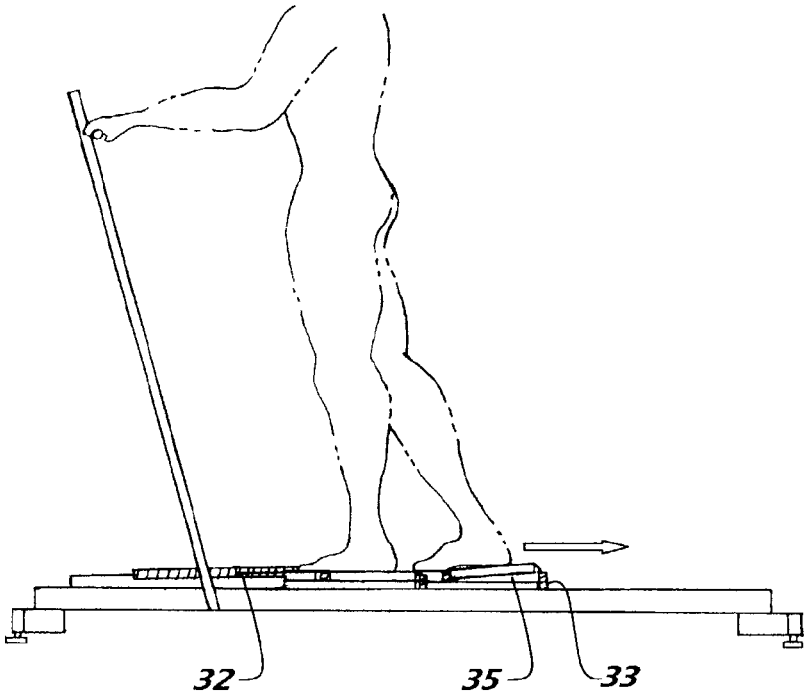
Figure 3C:
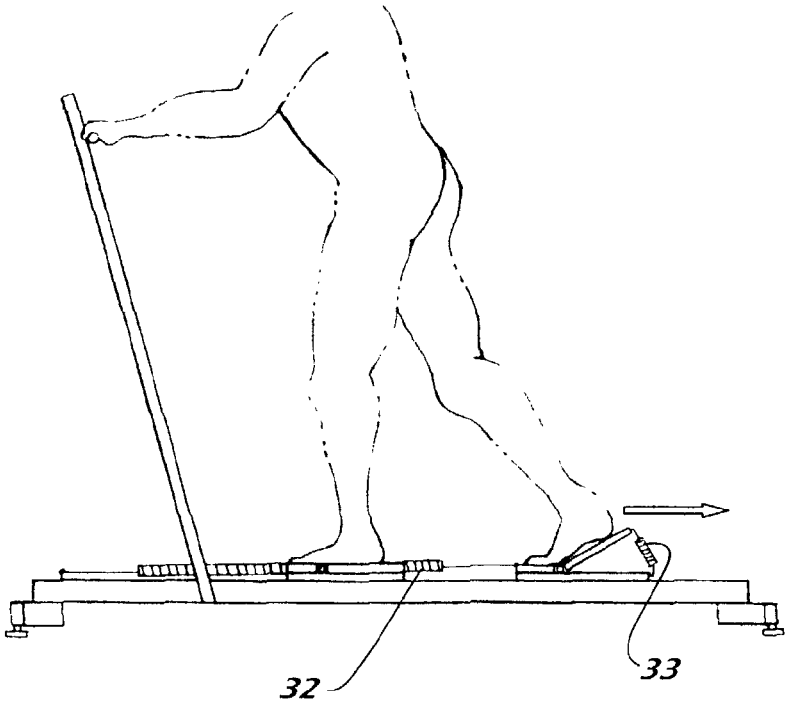
Figure 3D:
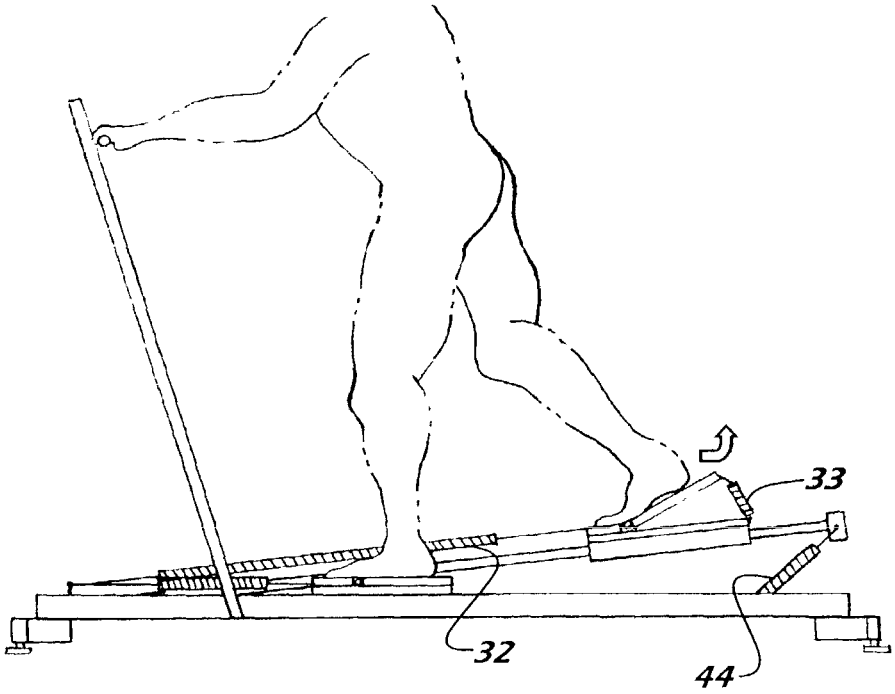
Figure 3E:
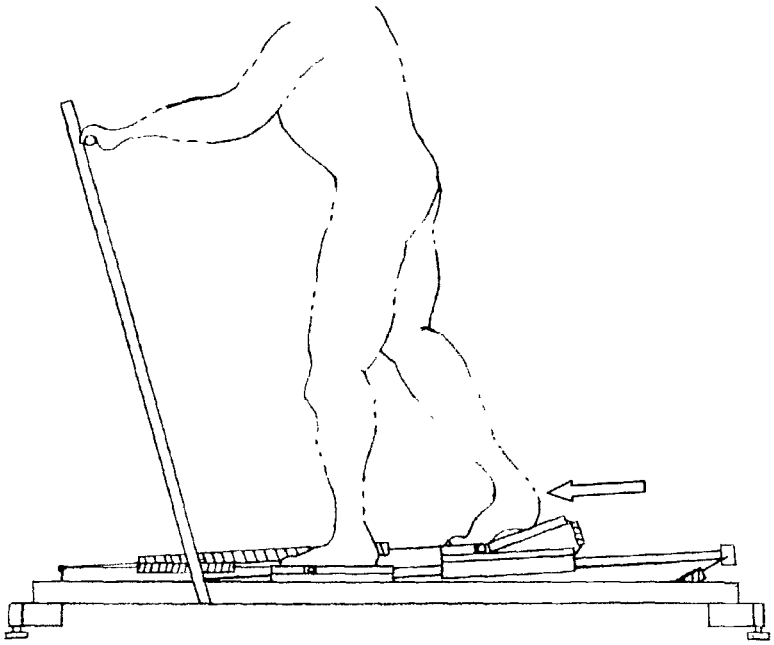

FIGS. 3A–3E sequentially illustrate a typical foot travel path and corresponding hip, leg, and foot positions of the present invention. FIG. 3A shows the foot and leg at a rest position prior to exercise with the foot properly positioned on the footplate assembly 30, with the ball of the foot directly over the footplate hinge 36. As shown next by FIG. 3B, as the foot and leg extend rearwardly, the GM must overcome the stride resistance element 32 as it extends the hip. Also the heel of the foot and the attached heel plate 35 are just starting to rise and engage the heel plate resistance element 33. Between the different positions shown by FIGS. 3B and 3C, the hamstring is engaged and takes over from the GM further overcoming the stride resistance element 32 and the heel plate resistance element 33 as the knee flexes and the foot bends. At the position shown in FIG. 3D, the HS is under the greatest load as now all three resistance elements 32, 33 and 44 are fully engaged. Finally, FIG. 3E shows the foot and leg striding forward toward the rest position and starting to unload the HS.

While typically both legs are exercised during a training session with alternating strides of sliding rearward and stepping forward, it is simple and possible to exercise only one leg by securing only the foot to be exercised to the footplate. It is also simple and possible for a user to exercise each leg differently. Resistance elements can be adjusted based on the strength of each leg. Differences in flexibility, leg to leg, are automatically accounted for by the sliding and pivotal elements.

It is also apparent that a device may be manufactured for the exercise of only a single leg if it is felt necessary to exercise each leg independently. Such a device would have, for example, only a single slide bar assembly including only a single footplate assembly.

While the device described above in FIG. 1 represents a preferred embodiment of the present invention, other devices can be imagined that, though mechanically distinct, would still preserve the training method outlined; namely, the sequentially firing, closed-kinetic-chain mode of training the GM and HS. Although mechanically distinct, these alternative embodiments may share various features, for example, the frame body assembly 10, the body support assembly 20, or (more particularly), the footplate assembly 30.

Figure 4:
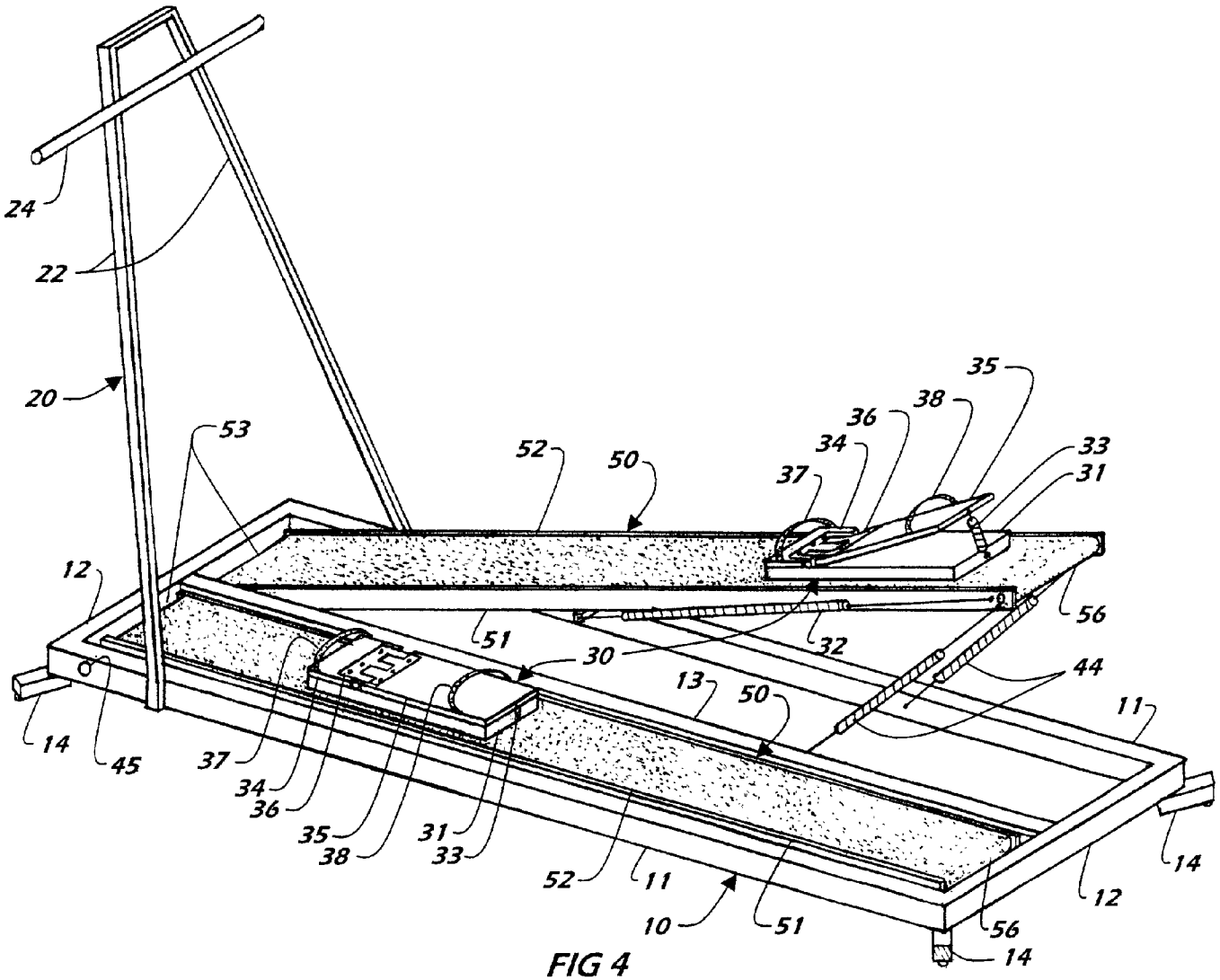
FIG. 4 is a perspective view of an alternative embodiment of the exercise device.

One such alternative embodiment, as shown by FIG. 4 described herein, comprises four main assemblies; a frame body assembly 10, a body support assembly 20, two footplate assemblies 30, and two continuous belt assemblies 50. In this device of FIG. 4 the slide bar assembly 40 of FIG. 1 is replaced by the continuous belt assembly 50 of FIG. 4. This substitution does not affect the training method but simply provides a different support and attachment point for the footplate assembly 30.

The frame body assembly 10 and the body support assembly 20 may be the same for the devices shown in FIGS. 1 and 4.

Like the slide bar assemblies 40, the continuous belt assemblies 50 are not linked together and thus can rotate independently about the common pivot axle 45. Continuous belt assemblies 50 include the continuous belt bed 51, the continuous belt 52, the front roller 53, and the back roller 56, and have a forward end and a back end. The pivot axle 45 is attached in the same manner as described in the device of FIG. 1 so that the continuous belt assembly can swing about the pivot axle 45 without contacting the short end member 12. The continuous belt bed 51 also has a forward end and a back end and is a relatively thin rectangular plate. Although thin, the continuous belt bed 51 is strong enough to support the forces exerted upon it during use. The upper surface is also of sufficiently low friction, either by surface treatment, small rollers, or the like, to allow the continuous belt 52 to slide across the surface unencumbered. The forward end of the continuous belt bed 51 is attached to the frame body assembly 10 by the pivot axle 45. Like the slide bar assemblies 40, continuous belt bed 51 rotates about the pivotal axle 45 following a fixed arcuate path from a position in the plane of the frame body assembly 10 to a position in the plane of the body support assembly 20. The continuous belt 52 is a belt, not unlike an endless treadmill belt, that encircles the continuous belt bed 51 along its long axis. At the forward end and back end of the continuous belt bed 51 are the front roller 53 and the back roller 56. The rollers are as wide or wider than the continuous belt 52, and are in the plane of the continuous belt bed 51 perpendicular to the long axis such that the continuous belt can move along the continuous belt bed 51 easily. Attached to the continuous belt bed 52 and the frame body assembly 10 are the pivot resistance elements 44. These are equivalents of the resistance elements described in the device of FIG. 1 and may be elastic bands, springs, hydraulic or pneumatic elements, etc. They provide fixed or adjustable resistance to the pivot of the continuous belt assembly 50 from its down or rest position in the plane of the frame body assembly 10 up toward the plane of the body support assembly 20. Attached to the continuous belt 52 on the under side of the continuous belt bed 51 and to the continuous belt bed 51 are the stride resistance elements 32. These may be the same type of elements described in the device of FIG. 1 and provide resistance to the movement of the belt as it moves across the continuous belt bed 51 from the forward end to the back end.

Completing the embodiment shown by FIG. 4 are the two identical footplate assemblies 30, one on each continuous belt assembly 50. They are the same as the footplate assemblies 30 of FIG. 1 except for the anchor plates 31. In the device of FIG. 1, the anchor plate 31 allows the footplate assembly 30 to ride back and forth on the slide bars 42, while in the device of FIG. 4 the anchor plate 31 is attached to the continuous belt 52 and thus the footplate assembly 30 rides back and forth with the continuous belt 52. Otherwise they operate in the same manner and provide the same function of securing the foot to the devices in the proper position of the ball of the foot over the footplate hinge 36.

Figure 5:
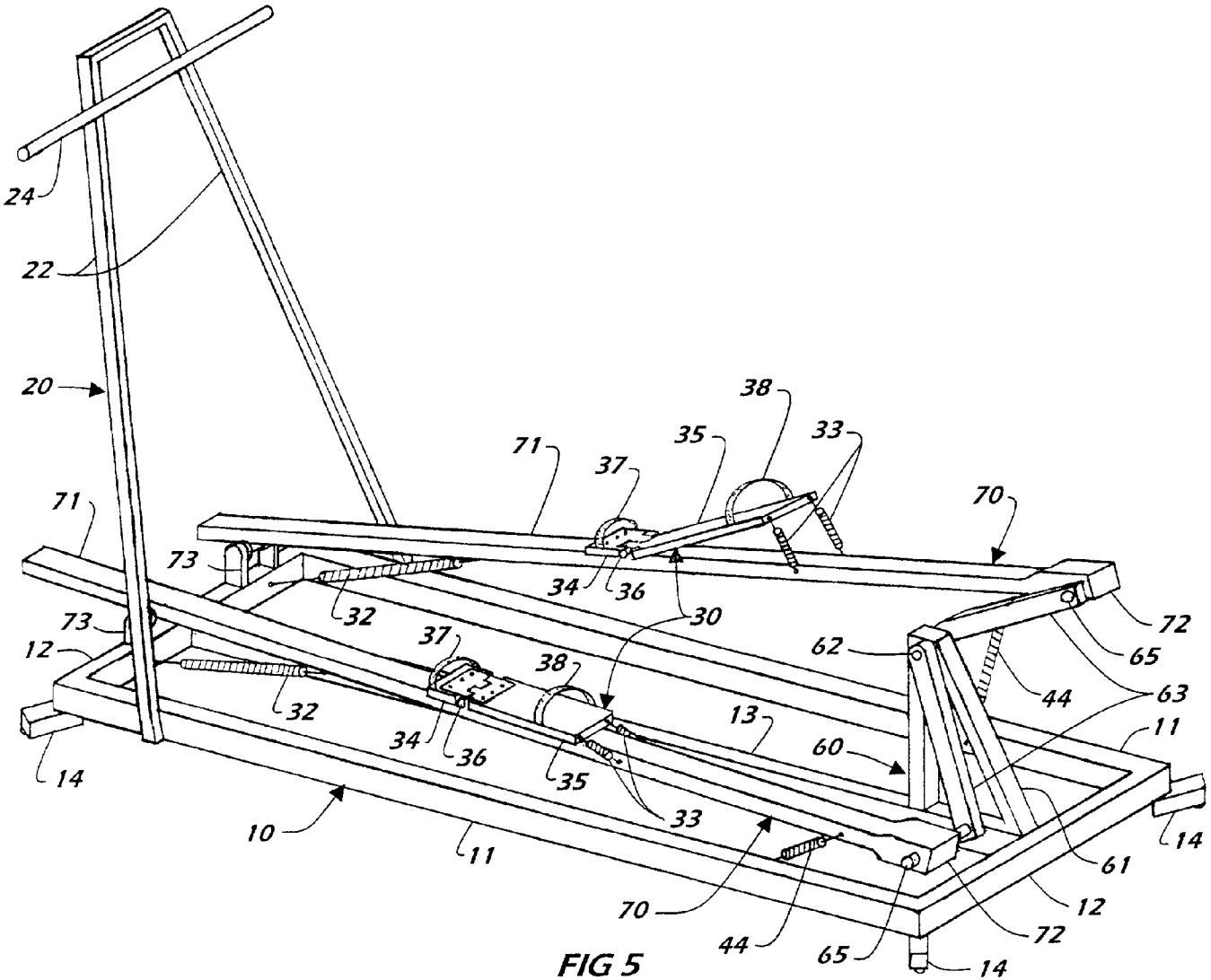
FIG. 5 is a perspective view of another alternative embodiment of the exercise device.

Another such exercise/training device, as shown in FIG. 5, comprises five main assemblies; a frame body assembly 10, a body support assembly 20, two footplate assemblies 30, crankshaft assembly 60, and two foot link assemblies 70. Though mechanically different, the device of FIG. 5 still provides the sequential firing, closed-kinetic-chain training method for the GM and HS described above for the devices of FIGS. 1 and 4.

The frame body assembly 10 and the body support assembly 20 may be the same for the embodiments of FIGS. 1 and 5.

Attached to the back end of the frame body is the crankshaft assembly 60. It comprises the support tower 61, the axle 62, the two connecting rods 63, and the two crankpins 65. The support tower 61 is attached to and projects up perpendicular to the long central member 13 of the frame body assembly 10 and houses the axle 62 and is tall enough for the connecting rod 63 to rotate about the axle 62 and not hit the floor or any part of the frame body. The axle 62 is mounted in the support tower 61 significantly parallel to the short end member 11 and the plane of the frame body assembly 10. It is also sufficiently strong that it can support the forces exerted upon it during use. The two connecting rods 63 are attached perpendicular to the axle 62 with bearings or bushings so that they rotate freely. The crankpins 65 are connected to the connecting rods with threads or bolts or the like, and are parallel to the axle 62 and thus perpendicular to the connecting rod 63. By providing a number of connection points, the crankpins 65 can be placed at varying distances from the axle 62. They extend out toward the side members 11 of the frame body. The result is that, when observed from a single side, the assembly looks not unlike the cranking portion of a hand-operated winch or windlass. The two connecting rods 63 and accompanying crankpins 65 are preferably not linked together and so are independent of one another in their pivot about the common axle 62 and are of sufficient strength to withstand the forces exerted upon them during use.

The foot link assemblies 70 are made up of the foot link 71, the foot link journal 72, and two foot link rollers 73. The foot links are generally elongated, thin, narrow (relative to their length) members with a forward end and a back end. They are sufficiently strong and stiff to withstand the weight and force of a person using the device without flexing significantly. The back end of the foot link 71 is connected to the crankpin 65 of the crankshaft assembly 60 via the foot link journal 72. Thus, as the connecting rod 63 rotates about the axle 62, the trailing foot link 71, through the foot link journal 72, turns freely about the crankpin 65. Though able to freely turn, the foot link 71 is also captured such that it cannot slide off the crankpin 65 during use. The forward end of the foot link 71 rides on the foot link roller 73. The foot link rollers 73 are mounted to the short end member 12 at the forward end of the frame body assembly 10. They are made such that the forward end of the foot link 71 rolls easily on the rollers but is prevented from going off either side of the roller during use. The resulting motion of the foot link 71 is an oscillation back and forth at the forward end on the foot link roller 73 as the back end of the foot link 71 revolves about the axle 62. The stride resistance elements 32 are attached to the foot link 71 and to the frame body assembly 10 and provide resistance to the movement of the foot link 71 as it travels back in its oscillation on the foot link roller 73. The pivot resistance element 44 is also attached to the foot link 71 and the frame body assembly 10 and provides resistance to the pivot of the foot link 71 up off the plane of the frame body assembly 10 as it rotates about the axle 62.

Completing the embodiment shown by FIG. 5 are the two identical footplate assemblies 30, one on each foot link 71. They may be the same as the footplate assemblies 30 of FIG. 1 and provide the same function of securing the foot to the devices in the proper position of the ball of the foot over the footplate hinge 36.

The device of FIG. 5 may also be adjusted for individual needs of the exerciser. Stride length can be adjusted by attaching the back end of the foot link 71, to the connecting rod 63, via the foot link journal 72 and crankpin 65, closer to or farther away from the axle 62. Knee flexion can be adjusted by moving the footplate assembly 30 closer to or farther away from the forward end of the foot link 71 FIG. 2, describing the foot travel path, and FIGS. 3A–3E, illustrating the hip, leg, and foot positions during use of the devices, pertain to the devices described in FIGS. 1, 4 and 5.

Shown simply as springs in the above drawings, the resistance elements of the three device designs described above may also be hydraulic, pneumatic, electro-mechanical devices or the like and could be adjustable both for force and speed. It is also apparent that an adjustable resistance element (as well as other aspects of the device) could be computer controlled. With computer control, the proper resistance elements, transducers, sensors, feedback loops, information capture and storage and the like, the use of the present devices could be broadened to include not only training but also strength, power, and endurance testing.

Although the devices described above are different in design, all share two essential concepts, the method of training and the footplate. The various embodiments mimic the walking or running stride and thus train the legs in a natural functional manner. The footplate anchors the foot to the device but allows it to flax naturally. This combination of the training method and the unique footplate, particularly including the heel plate resistance elements, trains the entire neuromuscular activity of the hip/knee joint complex. The resulting closed-kinetic-chain training isolates and selectively trains the GM and the HS, in their proper sequence, in a safe stabilizing training regime.

While the principles of the invention have been made clear in the illustrative embodiments set forth herein, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. An exercise device comprising:

a) a frame having a forward end and a back end;

b) a first subframe pivotally attached to the forward end of the frame, said first subframe having a forward end and a back end and a pivot resistance element providing resistance to pivoting of the first subframe with respect to the frame;

c) a footplate assembly movably attached to the first subframe and movable between the forward and back ends of the first subframe, and a stride resistance element providing resistance to movement of said footplate assembly toward the back end of said first subframe, wherein the footplate assembly includes a toe attachment and a heel attachment for securing a foot of a user to the footplate, and wherein the heel attachment may be raised with respect to the toe attachment and the subframe, against a heel plate resistance element.

2. An exercise device of claim 1 wherein said footplate assembly is movably attached to the first subframe assembly by two parallel slide bars.

3. An exercise device of claim 1 wherein said footplate assembly is movably attached to the first subframe assembly by a continuous belt.

4. An exercise device of claim 1 including a body support assembly with a handlebar, said body support assembly attached to the forward end of the frame.

5. An exercise device of claim 1 wherein a second subframe pivotally attached to the forward end of the frame in adjacent relationship to the first subframe, wherein:

a) the second subframe is pivotally attached to the forward end of the frame, said second subframe having a forward end and a back end and a pivot resistance element providing resistance to pivoting of the second subframe with respect to the frame;

b) a footplate assembly movably attached to the second subframe and movable between the forward and back ends of the second subframe, and a stride resistance element providing resistance to movement of said footplate assembly toward the back end of said first subframe, wherein the footplate assembly includes a toe attachment and a heel attachment for securing a foot of a user to the footplate, and wherein the heel attachment may be raised with respect to the toe attachment and the second subframe, against a heel plate resistance element.

6. An exercise device of claim 5 wherein said footplate assembly is movably attached to the second subframe assembly by two parallel slide bars.

7. An exercise device of claim 5 wherein said footplate assembly is movably attached to the second subframe assembly by a continuous belt.

8. An exercise device of claim 5 including a body support assembly with a handlebar, said body support assembly attached to the forward end of the frame.

9. An exercise device comprising:

a) a frame having a forward end and a back end, said back end including a crankshaft assembly rotatable about a crankshaft axle, said crankshaft assembly having a first crankpin offset from and rotatable about said crankshaft axle;

b) a first subframe pivotally and axially movable with respect to the forward end of the frame, said first subframe having a forward end and a back end and a pivot resistance element providing resistance to pivoting of the first subframe with respect to the frame, wherein the back end of the first subframe is pivotally attached to said first crankpin;

c) a footplate assembly attached to the first subframe, wherein the footplate assembly includes a toe attachment and a heel attachment for securing a foot of a user to the footplate, and wherein the heel attachment may be raised with respect to the toe attachment and the first subframe, against a heel plate resistance element.

10. An exercise device of claim 9 including a body support assembly with a handlebar, said body support assembly attached to the forward end of the frame.

11. An exercise device of claim 9 comprising:

a) a second crankpin included in said crankshaft assembly, said second crankpin offset from and rotatable about said crankshaft axle;

b) a second subframe, located in adjacent relationship to the first subframe, pivotally and axially movable with respect to the forward end of the frame, said second subframe having a forward end and a back end and a pivot resistance element providing resistance to pivoting of the second subframe with respect to the frame, wherein the back end of the second subframe is pivotally attached to said second crankpin;

c) a footplate assembly attached to the second subframe, wherein the footplate assembly includes a toe attachment and a heel attachment for securing a foot of a user to the footplate, and wherein the heel attachment may be raised with respect to the toe attachment and the second subframe, against a heel plate resistance element.

12. An exercise device of claim 11 including a body support assembly with a handlebar, said body support assembly attached to the forward end of the frame.

13. A method of exercising a lower body portion of a user, comprising the use of an exercise device including a footplate alternately movable in forward and rearward directions wherein rearward movement is against a first resistance element, said footplate being alternately movable in upward and downward directions wherein upward movement is against a second resistance element, and wherein the footplate includes toe and heel attachments allowing the user's heel to be raised with respect to a user's toes against a third resistance element, wherein said method comprises, a) attaching a foot of the user to the footplate via toe and heel attachments, such that said footplate allows the foot to bend in a natural manner but still be securely attached to said device; and b) sequentially exercising gluteus maximus and hamstring muscles of the user, wherein the resistance elements of said device provide resistance to the gluteus maximus and hamstring muscles during their sequential exercising through a walking or running stride cycle.

14. A method of exercising according to claim 13 wherein the resistance elements of said device provide resistance to the gluteus maximus and hamstring muscles during their sequential exercising through a walking or running stride cycle, by moving the heel of the foot of the user, from an initial starting position, in rearward and upward directions against resistance from the first, second and third resistance elements, followed by forward and downward movement of the foot as the foot is returned to the starting position.

* * * * *